US005236612A

United States Patent [19]

Rahman et al.

[11] Patent Number: 5,236,612

[45] Date of Patent: Aug. 17, 1993

[54] DETERGENT COMPOSITIONS COMPRISING ALKYL GLYCERATE COSURFACTANTS

[75] Inventors: Mohammad A. Rahman, River Edge; Robert W. Humphreys, Oradell; Shang-Ren Wu, Mahway, all of N.J.

[73] Assignee: Lever Brothers Company, Division of Conopco, Inc., New York, N.Y.

[21] Appl. No.: 815,445

[22] Filed: Dec. 31, 1991

[51] Int. Cl.[5] ..... C11D 7/06

[52] U.S. Cl. ..... 252/89.1; 252/156; 252/174.19

[58] Field of Search ..... 252/89.1, 156, 174.19

[56] References Cited

U.S. PATENT DOCUMENTS 3,925,224 12/1975 Winston ..... 252/89

*Primary Examiner*—Anthony McFarlane
*Assistant Examiner*—Nhat D. Phan
*Attorney, Agent, or Firm*—Ronald A. Koatz

[57] ABSTRACT

The present invention provides detergent compositions comprising alkyl glycerates as a coactive in combination with cosurfactants for enhanced removal of oil.

6 Claims, No Drawings

DETERGENT COMPOSITIONS COMPRISING ALKYL GLYCERATE COSURFACTANTS

BACKGROUND OF THE INVENTION

The present invention relates to detergent compositions comprising alkyl glycerate cosurfactants.

Alkyl glycerates are derived from glyceric acid, a natural substance present in the biochemical pathway of some microorganisms. While alkyl glycerates are known in the art, there is no teaching or suggestion of using these compounds as cosurfactants in detergent compositions for enhanced removal of oily substances. In particular, there is no teaching that using alkyl glycerates in a detergent composition with, for example, a nonionic surfactant (e.g. alcohol alkoxylates such as the Dobanol(®) surfactants from Shell) could result in enhanced oil detergency.

Because of increasing environmental concerns, it is greatly desirable to find naturally occurring, biodegradable compounds which can also act as surfactants or cosurfactants.

Thus, the ability to find such a renewable and environmentally friendly compound which is also a good detergent is considered a significant achievement.

SUMMARY OF THE INVENTION

The present invention relates to detergent compositions comprising alkyl glycerate cosurfactants. In particular the alkyl glycerate has the following formula:

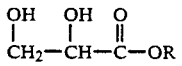

wherein R is a branched or unbranched, saturated or unsaturated hydrocarbon having 1 to 24, preferably 6 to 20 carbon atoms, wherein any or all hydrogens on the hydrocarbon group may be replaced by an alcohol group (i.e., R may be an alcohol or polyol).

DETAILED DESCRIPTION OF THE INVENTION

The present invention provides detergent compositions comprising an alkyl glycerate cosurfactant having the structure set forth below:

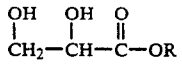

wherein R is a branched or unbranched alkyl group having 1 to 24, preferably 6 to 20 carbons.

Synthesis of Alkyl Glycerates

Glyceric acid can be converted to alkyl glycerate (e.g., methyl glycerate) with alkanol (e.g. (methanol) in the presence of hydrogen chloride which can then be transesterified with fatty alcohols ROH (wherein R is desired carbon chain length) to give alkyl glycerates in high yield as seen in Table 1 below. Although the methyl glycerate can be used without purification for the transesterification, it was isolated and characterized to confirm its formation. The transesterification of methyl glycerate with fatty alcohols was carried out in methanol at 70°-80° C. and atmospheric pressure. Methanol was continuously removed from the reaction flask using Dean Stark apparatus and the residue was purified to give the alkyl glycerate. Purification of the products can be obtained either by crystallization (light petroleum as solvent) or by column chromatography (eluting with hexane: ethyl acetate at a ratio of from about 5:1 to 10:1 [or must it be 9:1].). The purity of the products was verified by GC/MS and melting point (all the compounds melted within 1° C.).

Examples of the reaction are set forth below:

TABLE 1

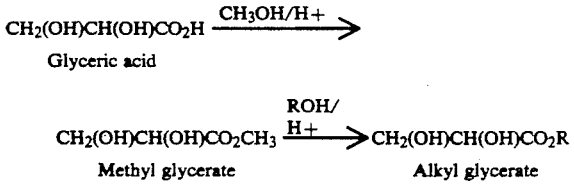

| Starting Alcohol | Product | Yield* | M.P. |
|---|---|---|---|
| $C_{10}H_{21}OH$ | $CH_2(OH)CH(OH)CO_2C_{10}H_{21}$ | 75% | 38-39° C. |
| $C_{12}H_{25}OH$ | $CH_2(OH)CH(OH)CO_2C_{12}H_{25}$ | 85% | 49-50° C. |
| $C_{14}H_{29}OH$ | $CH_2(OH)CH(OH)CO_2C_{14}H_{29}$ | 90% | 61-62° C. |
| $C_{16}H_{33}OH$ | $CH_2(OH)CH(OH)CO_2C_{16}H_{33}$ | 70% | 68-69° C. |

*Yield is determined after crystallization and purification. Crude yield is even higher.

Compositions

The surfactants of the invention may be used in cleansing or detergent composition such as heavy duty liquid detergents (generally enzyme containing) or powdered detergents. Examples of liquid or powdered detergents are described in U.S. Pat. No. 4,959,179 to Aronson (for liquid detergent compositions) and U.S. Pat. No. 4,929,379 Oldenburg et al. (for powdered compositions), both of which are incorporated herein by reference.

The liquid detergent compositions of the invention may be built or unbuilt and may be aqueous or nonaqueous. The compositions generally comprise about 5%-70% by weight of a detergent active material and from 0% to 50% of a builder. The liquid detergent compositions of the invention ma further comprise an amount of electrolyte (defined as any water-soluble salt) whose quantity depends on whether or not the composition is structured. By structured is meant the formation of a lamellar phase sufficient to endow solid suspending capability.

More particularly, while no electrolyte is required for a non-structured, non-suspending composition, at least 1%, more preferably at least 5% by weight and most preferably at least 15% by weight electrolyte is used. The formation of a lamellar phase can be detected by means well known to those skilled in the art.

The water-soluble electrolyte salt may be a detergency builder, such as the inorganic salt sodium tripolyphosphate or it may be a non-functional electrolyte such as sodium sulphate or chloride. Preferably, whatever builder is used in the composition comprises all or part of the electrolyte.

The liquid detergent composition generally further comprises enzymes such as proteases, lipases, amylases and cellulases which, when present, may be used in amounts from about 0.01 to 5% of the compositions. Stabilizers or stabilizer systems may be used in conjunction with enzymes and generally comprise from about 0.1 to 15% by weight of the composition.

The enzyme stabilization system may comprise calcium ion, boric acid, propylene glycol and/or short chain carboxylic acids. The composition preferably contains from about 0.01to about 50, preferably from about 0.1 to about 30, more preferably from about 1 to about 20 millimoles of calcium ion per liter.

When calcium ion is used, the level of calcium ion should be selected so that there is always some minimum level available for the enzyme after allowing for complexation with builders, etc., in the composition. Any water-soluble calcium salt can be used as the source of calcium ion, including calcium chloride, calcium formate, calcium acetate and calcium propionate. A small amount of calcium ion, generally from about 0.05 to about 2.5 millimoles per liter, is often also present in the composition due to calcium in the enzyme slurry and formula water.

Another enzyme stabilizer which may be used is propionic acid or a propionic acid salt capable of forming propionic acid. When used, this stabilizer may be used in an amount from about 0.1% to about 15% by weight of the composition.

Another preferred enzyme stabilizer is polyols containing only carbon, hydrogen and oxygen atoms. They preferably contain from 2 to 6 carbon atoms and from 2 to 6 hydroxy groups. Examples include propylene glycol (especially 1,2 propanediol which is preferred), ethylene glycol, glycerol, sorbitol, mannitol and glucose. The polyol generally represents from about 0.5% to about 15%, preferably from about 1.0% to about 8% by weight of the composition.

The composition herein may also optionally contain from about 0.25% to about 5%, most preferably from about 0.5% to about 3% by weight of boric acid. The boric acid may be, but is preferably not, formed by a compound capable of forming boric acid in the composition. Boric acid is preferred, although other compounds such as boric oxide, borax and other alkali metal borates (e.g. sodium ortho-, meta- and pyroborate and sodium pentaborate) are suitable. Substituted boric acids (e.g., phenylboronic acid, butane boronic acid and a p-bromo phenylboronic acid) can also be used in place of boric acid.

One especially preferred stabilization system is a polyol in combination with boric acid. Preferably, the weight ratio of polyol to boric acid added is at least 1, more preferably at least about 1.3.

With regard to the detergent active, the detergent active material may be an alkali metal or alkanolamine soap or a 10 to 24 carbon atom fatty acid, including polymerized fatty acids, or an anionic, a nonionic, cationic, zwitterionic or amphoteric synthetic detergent material, or mixtures of any of these.

Examples of the anionic synthetic detergents are salts (including sodium, potassium, ammonium and substituted ammonium salts) such as mono-, di- and triethanolamine salts of 9 to 20 carbon alkylbenzenesulphonates, 8 to 22 carbon primary or secondary alkanesulphonates, 8 to 24 carbon olefinsulphonates, sulphonated polycarboxylic acids prepared by sulphonation of the pyrolyzed product of alkaline earth metal citrates, e.g., as described in British Patent specification, 1,082,179, 8 to 22 carbon alkylsulphates, 8 to 24 carbon alkylpolyglycol-ether-sulphates, -carboxylates and -phosphates (containing up to 10 moles of ethylene oxide); further examples are described in "Surface Active Agents and Detergents" (vol. I and II) by Schwartz, Ferry and Bergh. Any suitable anionic may be used and the examples are not intended to be limiting in any way.

Examples of nonionic synthetic detergents which may be used with the invention are the condensation products of ethylene oxide, propylene oxide and/or battalion oxide with 8 to 18 carbon alkylphenols, 8 to 18 carbon fatty acid amides; further examples of nonionics include tertiary amine oxides with 8 to 18 carbon alkyl chain and two 1 to 3 carbon alkyl chains. The above reference also describes further examples of nonionics.

The average number of moles of ethylene oxide and/or propylene oxide present in the above nonionics varies from 1-30; mixtures of various nonionics, including mixtures of nonionics with a lower and a higher degree of alkoxylation, may also be used.

Examples of cationic detergents which may be used are the quaternary ammonium compounds such as alkyldimethylammonium halogenides.

Examples of amphoteric or zwitterionic detergents which may be used with the invention are N-alkylamine acids, sulphobetaines condensation products of fatty acids with protein hydrolysates; but owing to their relatively high costs they are usually used in combination with an anionic or a nonionic detergent. Mixtures of the various types of active detergents may also be used, and preference is given to mixtures of an anionic and a nonionic detergent active. Soaps (in the form of their sodium, potassium and substituted ammonium salts) of fatty acids may also be used, preferably in conjunction with an anionic and/or nonionic synthetic detergent.

Builders which can be used according to this invention include conventional alkaline detergency builders, inorganic or organic, which can be used at levels from 0% to about 50% by weight of the composition, preferably from 1% to about 20% by weight, most preferably from 2% to about 8%.

Examples of suitable inorganic alkaline detergency builders are water-soluble alkalimetal phosphates, polyphosphates, borates, silicates and also carbonates. Specific examples of such salts are sodium and potassium triphosphates, pyrophosphates, orthophosphates, hexametaphosphates, tetraborates, silicates and carbonates.

Examples of suitable organic alkaline detergency builder salts are: (1) water-soluble amino polycarboxylates, e.g., sodium and potassium ethylenediaminetetraacetates, nitrilotriacetates and N-(2 hydroxyethyl)-nitrilodiacetates; (2) water-soluble salts of phytic acid, e.g., sodium and potassium phytates (see U.S. Pat. No. 2,379,942); (3) water-soluble polyphosphonates, including specifically, sodium, potassium and lithium salts of ethane-1-hydroxy-1,1diphosphonic acid; sodium, potassium and lithium salts of methylene diphosphonic acid; sodium, potassium and lithium salts of ethylene diphosphonic acid; and sodium, potassium and lithium salts of ethane-1,1,2-triphosphonic acid. Other examples include the alkali metal salts of ethane-2-carboxy-1,1-diphosphonic acid hydroxymethanediphosphonic acid, carboxyldiphosphonic acid, ethane-1-hydroxy-1,1,2-triphosphonic acid, ethane-2-hydroxy-1,1,2-triphosphonic acid, propane-1,1,3,3-tetraphosphonic acid, propane-1,1,2,3-tetraphosphonic acid, and propane-1 2,2,3-tetraphosphonic acid; (4) water soluble salts of polycarboxylate polymers and copolymers as described in U.S. Pat. No. 3,308,067.

In addition, polycarboxylate builders can be used satisfactorily, including water-soluble salts of mellitic acid, citric acid, and carboxymethyloxysuccinic acid and salts of polymers of itaconic acid and maleic acid; other polycarboxylate builders include DPA (dipicolinic acid) and ODS (oxydisuccinic acid). Certain zeolites or aluminosilicates can be used. One such aluminosilicate which is useful in the compositions of the invention is an amorphous water-insoluble hydrated compound of the formula $Na_x(_yAlO_2.SiO_2)$, wherein x is a number from 1.0 to 1.2 and y is 1, said amorphous material being further characterized by a Mg++ exchange capacity of from about 50 mg eg. $CaCO_3$/g. and a particle diameter of from about 0.01 micron to about 5 microns. This ion exchange builder is more fully described in British Pat. No. 1,470,250.

A second water-insoluble synthetic aluminosilicate ion exchange material useful herein is crystalline in nature and has the formula $Na_z[(AlO_2)_y.(SiO_2)]xH_2O$, wherein z and y are integers of at least 6; the molar ratio of z to y is in the range from 1.0 to about 0.5, and x is an integer from about 15 to about 264; said aluminosilicate ion exchange material having a particle size diameter from about 0.1 micron to about 100 microns; a calcium ion exchange capacity on an anhydrous basis of at least about 200 milligrams equivalent of $CaCO_3$ hardness per gram; and a calcium exchange rate on an anhydrous basis of at least about 2 grams/gallon/minute/gram. These synthetic aluminosilicates are more fully described in British Pat. No. 1,429,143.

In addition to the ingredients described hereinbefore, the preferred compositions herein frequently contain a series of optional ingredients which are used for the known functionality in conventional levels. While the detergent compositions are generally premised on aqueous, enzyme-containing detergent compositions, it is frequently desirable to use a phase regulant. This component together with water constitutes then the solvent matrix for the claimed liquid compositions. Suitable phase regulants are well-known in liquid detergent technology and, for example, can be represented by hydrotropes such as salts of alkylarylsulfonates having up to 3 carbon atoms in the alkylgroup, e.g., sodium, potassium, ammonium and ethanolamine salts of xylene-, toluene-, ethylbenzene-, cumene-, and isopropylbenzene sulfonic acids. Alcohols may also be used as phase regulants. This phase regulant is frequently used in an amount from about 0.5% to about 20%, the sum of phase regulant and water is normally in the range from 35% to 65%.

The preferred compositions herein can contain a series of further optional ingredients which are mostly used in additive levels, usually below about 5%. Examples of the like additives include: polyacids, suds regulants, opacifiers, antioxidants, bactericides, dyes, perfumes, brighteners and the like.

The beneficial utilization of the claimed compositions under various usage conditions can require the utilization of a suds regulant. While generally all detergent suds regulants can be utilized, preferred for use herein are alkylated polysiloxanes such as dimethylpolysiloxane, also frequently termed silicones. The silicones are frequently used in a level not exceeding 0.5%, most preferably between 0.01% and 0.2%.

It can also be desirable to utilize opacifiers inasmuch as they contribute to create a uniform appearance of the concentrated liquid detergent compositions. Examples of suitable opacifiers include: polystyrene commercially known as LYTRON 621 manufactured by Monsanto Chemical Corporation. The opacifiers are frequently used in an amount from 0.3% to 1.5%.

The compositions herein can also contain known antioxidants for their known utility, frequently radical scavengers in the art established levels, i.e., 0.001% to 0.25% (by reference to total composition). These antioxidants are frequently introduced in conjunction with fatty acids.

The liquid detergent compositions of the invention may also contain deflocculating polymers such as described in U.S. Ser. No. 664,513 to Kaiserman et al. filed Mar. 5, 1991, hereby incorporated by reference.

When the liquid composition is an aqueous composition, the balance of the formulation consists of an aqueous medium. When it is in the form of a non-aqueous composition, the above ingredients make up for the whole formulation (a non-aqueous composition may contain up to about 5% water).

An ideal liquid detergent composition might contain (all percentages by weight):

(1) 5–70% detergent active;
(2) 0–50% builder;
(3) 0–40% electrolyte
(4) 0.01–5% enzyme;
(5) 0.1–15% enzyme stabilizer;
(6) 0–20% phase regulant; and
(7) remainder water and minors Thus, the alkyl glycerate is part of a detergent active system in which the cosurfactant used with the alkyl glycerate comprises from about 30–80% by weight, preferably 40–80% by weight of the detergent active system. The balance of the active system is the alkyl glycerate. The cosurfactant may be any of the detergent actives discussed above. The balance of the active system is provided by any of the detergent actives discussed above.

The detergent composition of the invention might also be a powdered detergent composition.

Such powdered compositions generally comprise from about 5–40% of a detergent active system which generally consists of an anionic, a nonionic active, a fatty acid soap or mixtures thereof; from 20–70% of an alkaline buffering agent; up to about 40% builder and balance minors and water.

The alkaline buffering agent may be any such agent capable of providing a 1% product solution with a pH of above 11.5 or even 12. Advantageous alkaline buffering agents are the alkalimetal silicates, as they decrease the corrosion of metal parts in washing machines, and in particular sodium orthometa- or di-silicates, of which sodium metasilicate is preferred. The alkaline buffering agent is present in an amount of from 0 to 70% by weight, preferably from 0 to 30% by weight.

In addition the compositions of the invention can and normally will contain detergency builders in an amount of up to 40% by weight and preferably from 5 to 25% by weight of the total composition.

Suitable builders include sodium, potassium and ammonium or substituted ammonium pyro- and tri-polyphosphates, -ethylene diamine tetraacetates, -nitrilotriacetates, -etherpolycarboxylates, -citrates, -carbonates, -orthophosphates, -carboxymethyloxysuccinates, etc. Other builders include DPA and ODS. Also less soluble builders may be included, such as e.g., an easily dispersible zeolite. Particularly preferred are the polyphosphate builder salts, nitrilotriacetates, citrates, carboxymethyloxysuccinates and mixtures thereof.

Other conventional materials may be present in minor amounts, provided they exhibit a good dissolving or dispersing behavior; for example sequestering agents, such as ethylenediamine tetraphosphonic acid; soil-suspending agents, such as sodiumcarboxymethylcellulose, polyvinylpyrrolidone or the maleic anhydride/ vinylmethylether copolymer, hydrotropes; dyes; perfumes; optical brighteners; alkali-stable enzymes; germicides; anti-tarnishing agents; lather depressants; fabric softening agents; oxygen- or chlorine-liberating bleaches, such as dichlorocyanuric acid salts or alkalimetal hypochlorides.

The remainder of the composition is water, which is preferably present in hydrated form, such as e.g., in the form of silicate 5 aq.

An ideal powdered detergent composition might contain the following (all percentages by weight):

(1) 5–40% detergent active;
(2) 0–40% builder;
(3) 0–30% buffer salt;
(4) 0–30% sulfate;
(5) 0–20% bleach system;
(6) 0–4% enzyme;
(7) minors plus water to 100%

While various compositions are described above, these should not be understood to be limiting as to what other compositions may be used since other compositions which may be known to those of ordinary skill in the art are also contemplated by this invention.

The invention is set forth in greater detail in the examples which follow below. These examples are merely to illustrate the invention and are not intended to be limiting in any way.

Methodology

Melting points were determined in capillary tubes using Mel-Temp II melting point apparatus and are uncorrected. Infrared (IR) spectra were recorded on a Perkin-Elmer model 298 spectrometer or a Nicolet 5SX FT IR spectrometer using sodium chloride plates in nujol for solids and thin films for liquids or syrups.

Glyceric Acid

The calcium salt of (dl) glyceric acid (10 g) (from Aldrich) was added to ion exchange resin IR-120H+(10 g) in water (150 mL) and was stirred overnight at room temperature. The resin was removed by filtration under suction and water was removed on rotary evaporator. The free glyceric acid thus obtained (8.5 g) was used for the next step without further purification.

EXAMPLE 1

Preparatory of Methyl Glycerate

A solution of free glyceric acid obtained as described above (25 g, 0.235 mol) in methanolic hydrogen chlorine (2%, 150 mL) was heated to reflux for 3H under nitrogen. The solvent was removed on rotary evaporator and the residue was dissolved in large volume of chloroform (200 mL) and dried over anhydrous sodium carbonate (10 g) to neutralize the free acid. After filtration, the solvent was removed on rotary evaporator which gave the product (24.83 g, 88% yield).

EXAMPLES 2–5

Preparation of $C_{10}$, $C_{12}$, $C_{14}$ & $C_{16}$ Glycerate

The higher alkyl glycerates ($C_{10}$, $C_{12}$, $C_{14}$ & $C_{16}$) were synthesized by ester exchange methodology. To a solution of methyl glycerate (5 g) in methanolic hydrogen chloride (2%, 150 mL) was added higher alcohol (1.15 equivalent) and the resulting solution was refluxed under nitrogen and methanol was continuously removed by Dean Stark apparatus. In most cases the reaction was completed in 5 H. Finally the last trace of methanol was removed on rotary evaporator. The residue was dissolved in large volume of chloroform (200 mL) and dried over anhydrous sodium carbonate for 2 H. Filtration and removal of the solvent gave the crude product which was purified on silica gel column eluting with hexane: ethyl acetate (7:3). The unreacted alcohol was eluted first. The glycerates can be recrystallized from light petroleum ether.

Surfactancy

In order to determine the effectiveness of these alkyl glycerate compounds as surfactant, various physical properties (i.e., CMC, Krafft point, detergency) are tested. These results are discussed in Examples 6–8 below.

EXAMPLE 6

Critical Micelle Concentration (CMC)

The CMC is defined as the concentration of a surfactant at which it begins to form micelles in solution. Specifically, materials that contain both a hydrophobic group and a hydrophilic group (such as surfactants) will tend to distort the structure of the solvent (i.e., water) they are in and therefore increase the free energy of the system. They therefore concentrate at the surface, where, by orienting so that their hydrophobic groups are directed away from the solvent, the free energy of the solution is minimized. Another means of minimizing the free energy can be achieved by the aggregation of these surface-active molecules into clusters or micelles with their hydrophobic groups directed toward the interior of the cluster and their hydrophilic groups directed toward the solvent.

The value of the CMC is determined by surface tension measurements using the Wilhemy plate method. While not wishing to be bound by theory, it is believed that a low CMC is a measure of surface activity (i.e., lower CMC of one surfactant versus another indicates the surfactant with lower CMC is more surface active). In this regard, it is believed that lower CMC signifies that lesser amounts of a surfactant are required to provide the same surfactancy benefits as a surfactant with higher CMC.

The CMC for $C_{10}$ glycerate and the CMC for $C_{12}$ glycerate (both measured at 40° C.) were measured at $3.91\times10^{-4}$M and $3\ 36\times10^{-4}$M, respectively while, by comparison, the CMC for a heptaethoxylated dodecyl alcohol (typical nonionic) is $7.3\times10^{-5}$M (at 40° C.). Thus, it can be seen that CMC values for these glycerates and commercially available glycerates (i.e., $C_{12}$ EO7) are comparable.

EXAMPLE 7

Krafft Points

The temperature at and above which surfactants begin to form micelles is referred to as Krafft point (Tk) and at this temperature the solubility of a surfactant becomes equal to its CMC.

Krafft point was measured by preparing a 1% dispersion of the surfactant in water. If the surfactant was soluble at room temperature, the solution was cooled to 0° C. When the surfactant did not precipitate out, its Krafft point was considered to be <0° C. If it precipitated out, the solution was slowly warmed with stirring in a water bath. The temperature at which the precipitate dissolved was determined to be the Krafft point.

If the Krafft point was above room temperature, the solution was first heated rapidly to dissolve all the surfactant. It was then cooled until precipitation occurred, and was then slowly warmed to determine the Krafft point described above.

While not wishing to be bound by theory, it is believed that lower Krafft points are indicative of a surfactant being more soluble in aqueous system. Also, since micelles exist only at temperature above Tk, surfactants with high Tk will show lower activity at low temperatures.

Krafft point measurements indicated that Krafft point for $C_{10}$ glycerate was 20° C. and 36° C. for $C_{12}$ glycerate. Once again, those values are comparable to other well known commercially available surfactants indicating that the biodegradable glycerates of the invention are a viable alternative to those other surfactants.

EXAMPLE 8

Detergency

The detergency of the alkyl glycerates as a cosurfactant in detergent compositions was measured by recording the % triolein (a grease substance) removed (as an absolute value) from polyester using $C_{10}$ or $C_{12}$ glycerate as cosurfactant together with $C_{12}E_8$ (octaethylene glycol mono-dodecyl ether) and comparing to a $C_{10}$ monoglyceryl ether/$C_{12}E_8$ mixture.

More particularly, the amount of soil removed was evaluated using 3H ratio-labelled triolein. Following the wash, 4×1 ml samples of wash liquor were removed from each pot and the activity determined using a liquid scintillation counter. Percentage detergencies were calculated from the relationship.

$$\% \text{ detergency} = \frac{Aw \times 100}{As}$$

Aw=total activity in wash liquor

As=level of activity originally applied to cloth

Using these methods, the following results were obtained:

| % Detergency Based on Various Ratios of Alkyl Glycerate ($C_{10}$ or $C_{12}$) or of $C_{10}$ Monoglyceric ether to $C_{12}$ $E_8$ (Nonionic) | | | | | | |
|---|---|---|---|---|---|---|
| | 100% Glyceride or $C_{10}$ Gly. Ether | 80/20 | 60/40 | 40/60 | 20/80 | 100% $C_{12}E_8$ |
| Detergency for $C_{10}$ Glycerate | 3% | 9% | 68% | 72% | 70% | 58% |
| Detergency for $C_{12}$ Glycerate | 2% | 5% | 41% | 76% | 71% | 58% |
| Detergency for $C_{10}$ Monoglyceryl Ether | 4% | 9% | 78% | 77% | 70% | 58% |

First it should be noted that anything above about 40% is considered good detergency. Thus it can be seen that neither the glycerates or the monoglyceryl ether offer good detergency properties when used alone and not as a cosurfactant.

However, at a range of about 30% cosurfactant, preferably from about 40% to 80% cosurfactant, the glycerate functions together with the cosurfactant (e.g. nonionic $C_{12}E_8$) to provide enhanced detergency against greasy substrate such as triolein.

Thus, the invention provides biodegradable glycerates which can be used as cosurfactants together with other surfactants to provide enhanced detergency.

While not wishing to be bound by theory, because of the relatively hydrophobic nature of the glycerates, it is believed optimum detergency is obtained using, as a cosurfactant with the glycerate, compounds having a relatively high hydrophilic to liphophilic balance.

We claim:

1. Detergent composition comprising a detergent active system comprising a cosurfactant and alkyl glycerate wherein the cosurfactant comprises 30–90% by weight of the active system and the balance of the active system comprises alkyl glycerate and wherein the cosurfactant is selected from the group consisting of soap, anionic surfactants, nonionic surfactants, cationic surfactants, amphoteric surfactants and zwitterionic surfactants.

2. A detergent composition according to claim 1 wherein the alkyl glycerate has the formula:

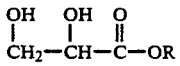

wherein R is a branched or unbranched, saturated or unsaturated alkyl forming a hydrocarbon group having 1 to 24 carbons.

3. A detergent composition according to claim 2 wherein one or more hydrogen atoms on the hydrocarbon group formed from the R of the alkyl glycerate is replaced by an alcohol group.

4. A detergent composition according to claim 1 wherein the composition is a liquid composition which additionally comprises:

(1) 0–50% by weight builder;
(2) 0–40% by weight electrolyte;
(3) 0.01–5% by weight enzyme;
(4) 0.1–15% by weight enzyme stabilizer;
(5) 0–2% by weight phase regulant; and
(6) 0–95% by weight water.

5. A composition according to claim 1, wherein the composition is a powder composition.

6. A composition according to claim 5, which comprises:

(1) 5–40% by weight detergent active;
(2) 0–40% by weight builder;
(3) 0–30% by weight buffer salt;
(4) 0–30% by weight sulfate;
(5) 0–20% by weight bleach system;
(6) 0–4% by weight enzyme; and
(7) 0 to 95% by weight water.

* * * * *